US008947315B2

(12) United States Patent
Onaka et al.

(10) Patent No.: US 8,947,315 B2
(45) Date of Patent: Feb. 3, 2015

(54) MULTIBAND ANTENNA AND MOUNTING STRUCTURE FOR MULTIBAND ANTENNA

(75) Inventors: Kengo Onaka, Yokohama (JP); Tsuyoshi Mukai, Nagaokakyo (JP); Munehisa Watanabe, Yasu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 812 days.

(21) Appl. No.: 12/958,049

(22) Filed: Dec. 1, 2010

(65) Prior Publication Data

US 2011/0134009 A1 Jun. 9, 2011

Related U.S. Application Data

(63) Continuation of application No. PCT/JP2009/055104, filed on Mar. 17, 2009.

(30) Foreign Application Priority Data

Jun. 6, 2008 (JP) ..... 2008-149651

(51) Int. Cl.
*H01Q 21/00* (2006.01)
*H01Q 5/00* (2006.01)
(Continued)

(52) U.S. Cl.
CPC ..... *H01Q 5/0068* (2013.01); *H01Q 1/243* (2013.01); *H01Q 1/38* (2013.01); *H01Q 5/0041* (2013.01); *H01Q 9/42* (2013.01)
USPC ..... 343/853; 343/700 MS; 343/833; 343/895; 343/786; 343/756

(58) Field of Classification Search
USPC ..... 343/700 MS, 702, 895, 786, 756, 767, 343/833
See application file for complete search history.

(56) References Cited

U.S. PATENT DOCUMENTS

2002/0044092 A1 4/2002 Kushihi
2005/0190107 A1 * 9/2005 Takagi et al. ..... 343/702
(Continued)

FOREIGN PATENT DOCUMENTS

JP 2000-278028 A 10/2000
JP 2002-076750 A 3/2002
(Continued)

OTHER PUBLICATIONS

M. Yoshimura; "International Search Report"; PCT/JP2009/055104; May 26, 2009.
(Continued)

*Primary Examiner* — Sue A Purvis
*Assistant Examiner* — Jae Kim
(74) *Attorney, Agent, or Firm* — Studebaker & Brackett PC

(57) ABSTRACT

An antenna that resonates at each of at least operating two frequency bands includes a first LC parallel circuit having a first impedance between a feeding element and a feeding circuit, and a second LC parallel circuit having a second impedance between a parasitic element and ground. The feeding element and the parasitic element are configured such that multiple resonant frequencies are positioned between the two operating frequency bands in a case where the impedances of the first and second LC parallel circuits are set to 0, and the LC parallel circuits having the first and second impedances cause the multiple resonance frequencies to shift to an operating frequency band on the lower frequency side and to the higher frequency side, of the two operating frequency bands.

20 Claims, 6 Drawing Sheets

(51) Int. Cl.

| | |
|---|---|
| ***H01Q 1/24*** | (2006.01) |
| ***H01Q 1/38*** | (2006.01) |
| ***H01Q 9/42*** | (2006.01) |

(56) References Cited

U.S. PATENT DOCUMENTS

| | | | | |
|---|---|---|---|---|
| 2006/0214857 | A1* | 9/2006 | Ollikainen | 343/702 |
| 2007/0285335 | A1 | 12/2007 | Bungo et al. | |
| 2010/0295737 | A1* | 11/2010 | Milosavljevic et al. | 343/702 |

FOREIGN PATENT DOCUMENTS

| | | | | |
|---|---|---|---|---|
| JP | 2005-295493 | A | 10/2005 | |
| JP | 2006-067234 | A | 3/2006 | |
| JP | 2007-306507 | A | 11/2007 | |
| WO | WO 2007012697 | A1 * | 2/2007 | H01Q 1/24 |

OTHER PUBLICATIONS

M. Yoshimura; "Written Opinion of the International Searching Authority"; PCT/JP2009/0055104; May 26, 2009.

* cited by examiner

FIG.7A
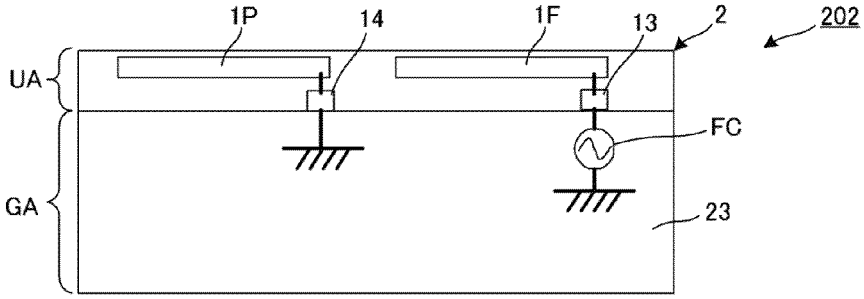
FIG.7B
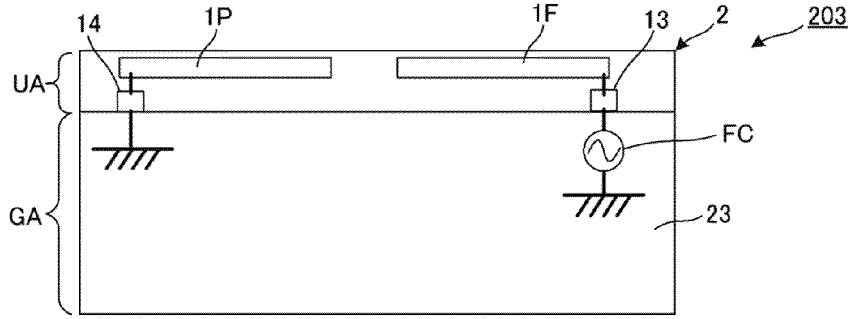
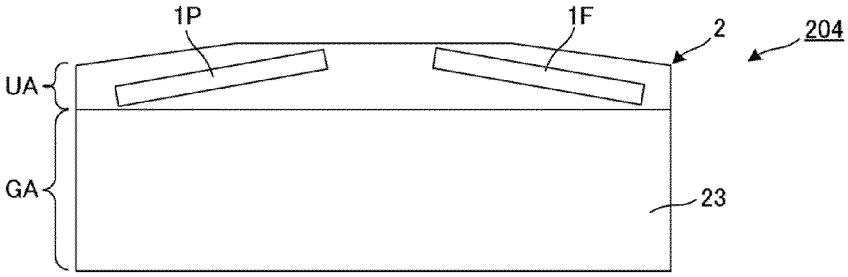
FIG.8
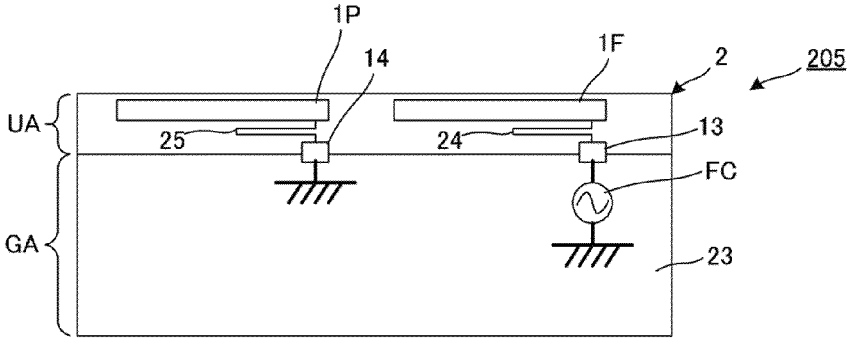
FIG.9

MULTIBAND ANTENNA AND MOUNTING STRUCTURE FOR MULTIBAND ANTENNA

CROSS REFERENCE TO RELATED APPLICATIONS

The present application is a continuation of International Application No. PCT/JP2009/055104 filed Mar. 17, 2009, which claims priority to Japanese Patent Application No. 2008-149651 filed Jun. 6, 2008, the entire contents of each of these applications being incorporated herein by reference in their entirety.

FIELD OF THE INVENTION

The present invention relates to a multiband antenna used for a wireless communication device, such as a mobile phone terminal, and to a mounting structure for the multiband antenna.

BACKGROUND

Japanese Unexamined Patent Application Publication No. 2006-067234 (Patent Document 1) discloses an antenna that handles a plurality of frequency bands with a single antenna. The configuration of the antenna disclosed in Patent Document 1 will be described with reference to FIG. 1. In the example of FIG. 1, an antenna device 100 includes a dielectric substrate 101, a feeding point 102, a monopole antenna 103, a parallel circuit 104, an antenna element 105, and a parasitic element 106.

In FIG. 1, the hatched portion of the dielectric substrate 101 is a ground of the antenna device 100, and a circuit for performing signal processing of wireless communication is mounted in the hatched portion. The monopole antenna 103 is connected to the feeding point 102. The parallel circuit 104 is connected to the monopole antenna 103. The antenna element 105 is connected to the parallel circuit 104. One side of the parasitic element 106 is connected to the ground in the vicinity of the feeding point 102.

The monopole antenna 103 has a length of approximately ¼ of the wavelength at a frequency f1. The parallel circuit 104 is formed from a parallel resonance circuit constituted by an inductor and a capacitor, which cut off the electrical current of the frequency f1. The antenna element 105, together with the monopole antenna 103 and the parallel circuit 104, has a length approximately ¼ the wavelength at a frequency f2 which is relatively lower than the frequency f1. The parasitic element 106 has a length which is approximately ¼ the wavelength at the frequency f1.

The monopole antenna 103 is connected to the parallel circuit 104, and the parallel circuit 104 is formed of an inductor and a capacitor, which cut off the electrical current of the frequency f1.

In this antenna device 100, the monopole antenna 103 operates by itself at the frequency f1.

As described above, in the antenna device 100, the monopole antenna 103 and the parasitic element 106 operate as an antenna device at the frequency f1. At the frequency f2, the antenna element 105, together with the monopole antenna 103 and the parallel circuit 104, operates as an antenna of a length of approximately ¼.

However, in the antenna device disclosed in Patent Document 1, a parallel resonance circuit is used to cut off the electrical current of a specific frequency f1, and this parallel resonance circuit is inserted into the middle of a radiation electrode. For this reason, the following problems arise:

(1) At the frequency f1, antenna radiation electrodes included in and in a stage subsequent to the parallel resonance circuit are not viewed equivalently, that is, appear to be small. As a result, at a high operating frequency, since the volume of the antenna is decreased equivalently, this is disadvantageous in terms of the performance of the antenna.

(2) Since the antenna operates at a resonance frequency of the lowest Q (with a large loss) of the parallel resonance circuit, an influence due to the loss of the parallel resonance circuit is directly received.

(3) With only the parallel resonance circuit, the electrical current cannot be cut off over the entire range of the high operating frequency. For this reason, interference with generated harmonics occurs, and the performance is deteriorated.

(4) In a case where a three-dimensional radiation electrode is to be formed, rather than the radiation electrode being formed by an electrode pattern on a substrate, a parallel resonance circuit needs to be inserted into the middle of the radiation electrode. In consequence, the radiation electrode needs to be divided in the middle and also, elements need to be directly mounted on the radiation electrode. Therefore, many difficulties are caused to occur in the manufacture of the electrode.

SUMMARY

The claimed invention is directed to a multiband antenna with a low loss and a high gain at an operating frequency, and a mounting structure for the multiband antenna.

A multiband antenna consistent with the claimed invention resonates at each of at least two operating frequency bands on a lower frequency side and on a higher frequency side. The multiband antenna has a feeding radiation electrode and a parasitic radiation electrode formed on a dielectric base, and includes a first LC parallel circuit between the feeding radiation electrode and a feeding circuit, and a second LC parallel circuit between the parasitic radiation electrode and a ground. Multiple resonance frequencies of the feeding element including a feeding radiation electrode and the parasitic element including a parasitic radiation electrode are frequencies between two operating frequency bands in a case where impedances of the first and second LC parallel circuits are set to 0, and the LC parallel circuits cause the multiple resonance frequencies to shift to an operating frequency band on the lower frequency side of the two operating frequency bands, and cause the multiple resonance frequencies to shift to an operating frequency band on the higher frequency side of the two operating frequency bands.

According to a more specific embodiment consistent with the claimed invention, a circuit element having inductance components may be provided in series with the first LC parallel circuit and may be provided in series with the second LC parallel circuit.

In accordance with another more specific embodiment, a mounting structure for a substrate of a multiband antenna according to any of the above embodiments includes a ground area in which a ground electrode is formed and a non-ground area in which a ground electrode is not formed in an end portion thereof. The multiband antenna is provided in the non-ground area of the substrate.

In another more specific embodiment, the feeding radiation electrode and the parasitic radiation electrode are provided on a main surface of the substrate farthest from the ground area of the substrate.

In yet another more specific embodiment of the mounting structure, the feeding element and the parasitic element may be provided in individual dielectric bases, and the feeding element and the parasitic element may be arranged adjacent to each other.

According to another more specific embodiment of the mounting structure, the circuit element having inductance components may be a pattern electrode formed on the substrate.

Other features, elements and characteristics of the claimed invention will become more apparent from the following detailed description of preferred embodiments of the present invention with reference to the attached drawings.

BRIEF DESCRIPTION OF DRAWINGS

FIGS. 7A and 7B are plan views of antennas according to a second exemplary embodiment, which are configured in such a manner that the antennas are multiply resonated by using two antenna elements.

FIG. 8 is a plan view of an antenna according to a third exemplary embodiment.

FIG. 9 is a plan view of an antenna according to a fourth exemplary embodiment.

DETAILED DESCRIPTION

A description will be given, with reference to FIGS. 2 to 6, of a multiband antenna and a mounting structure for the multiband antenna according to the first exemplary embodiment.

Figure 1:
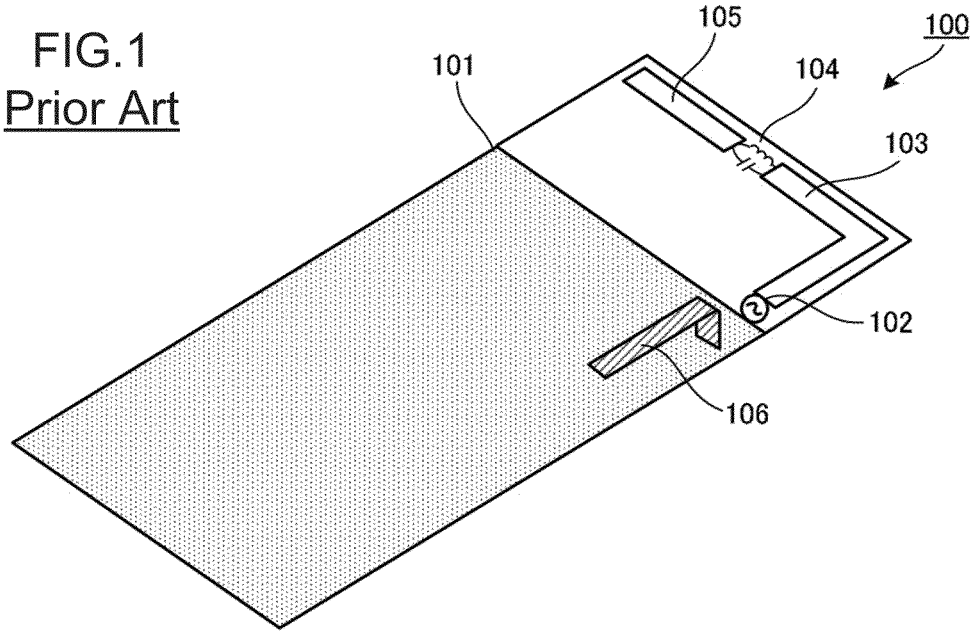
FIG.1 Prior Art
FIG. 1 shows the configuration of an antenna disclosed in Patent Document 1.
Figure 2A:
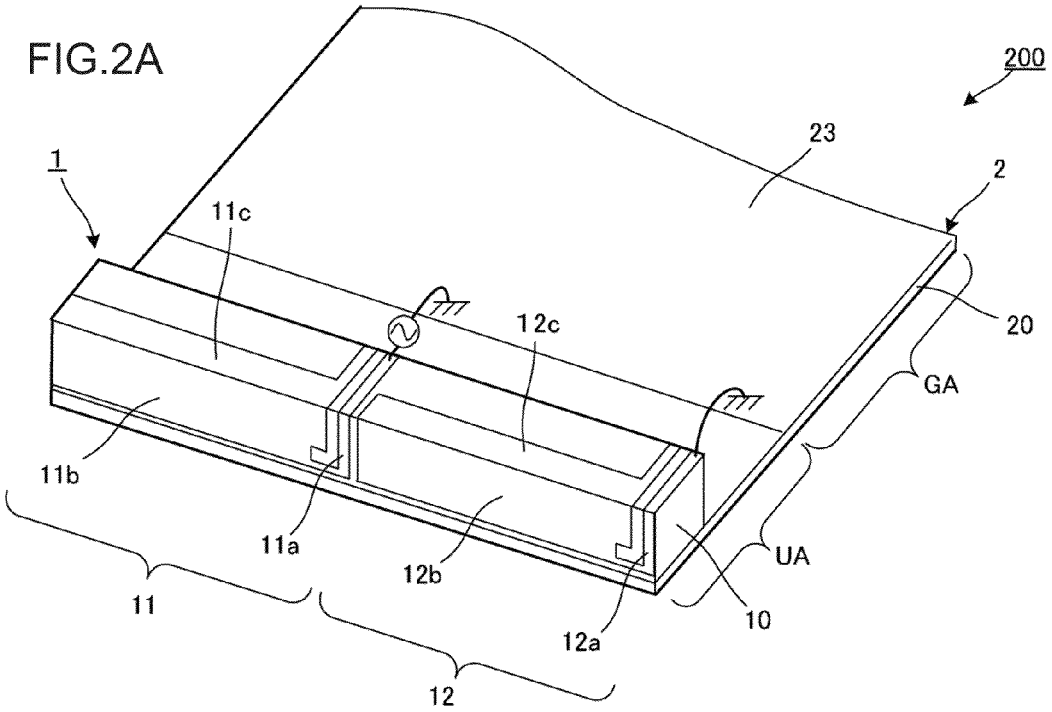
FIGS. 2A and 2B are perspective views showing the configuration of a multiband antenna according to a first exemplary embodiment incorporated in the housing of a wireless communication device, such as a mobile phone terminal.
Figure 2B:
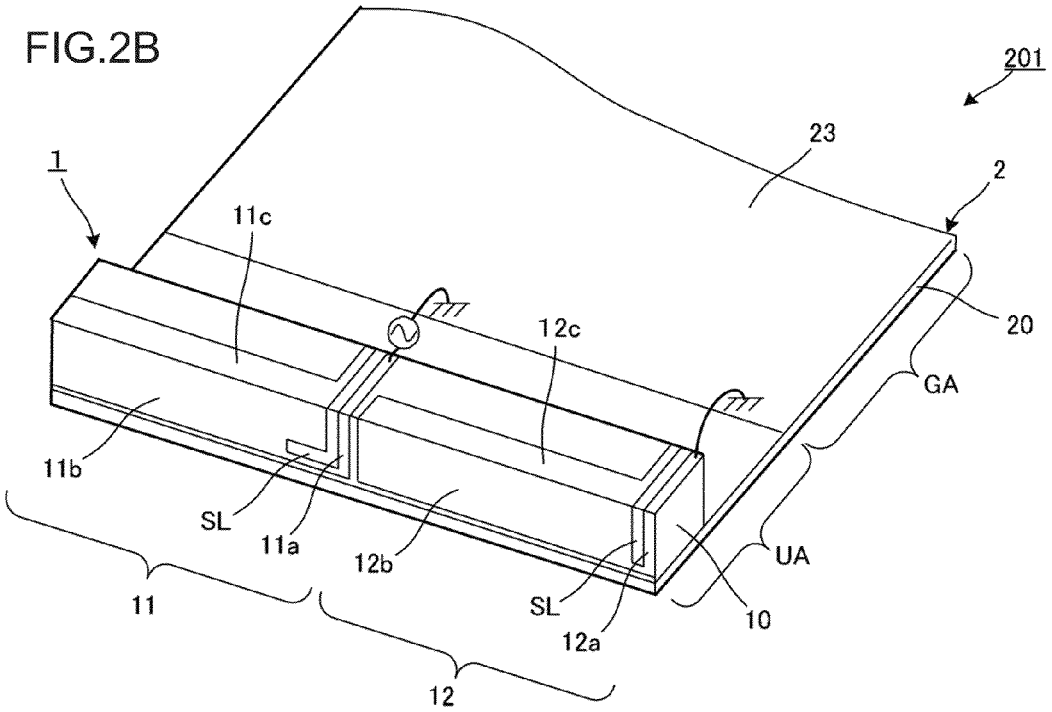

FIGS. 2A and 2B are perspective views showing examples of two configurations of a multiband antenna (hereinafter referred to simply as an "antenna") incorporated inside the housing of a wireless communication device, such as a mobile phone terminal. Antennas 200 and 201 each include an antenna element 1 having a predetermined electrode formed on a dielectric base 10 in a prismatic shape or in a shape matching the housing of a wireless communication device, and a substrate 2 having a predetermined electrode formed on a base 20.

The substrate 2 has a ground area GA in which a ground electrode 23 is formed on the base 20, and a non-ground area UA in which a ground electrode 23 is not formed, the non-ground area UA extending in the vicinity of one side of the substrate 2. The antenna element 1 is arranged at a position spaced apart from the ground area GA as much as possible in the non-ground area UA.

The dielectric base 10 is formed with various electrode patterns. On the feeding side, feeding radiation electrodes 11*b* and 11*c*, and a line 11*a* therefor are formed. The dielectric base 10, the feeding radiation electrodes 11*b* and 11*c*, and the line 11*a* constitute a feeding element 11. On the parasitic side, parasitic radiation electrodes 12*b* and 12*c*, and a line 12*a* therefore are formed. The dielectric base 10, the parasitic radiation electrodes 12*b* and 12*c*, and the line 12*a* constitute a parasitic element 12. As described above, the feeding element 11 and the parasitic element 12 are arranged adjacent to each other.

The length of the slit SL formed in the feeding radiation electrodes 11*b* and 11*c* and the parasitic radiation electrodes 12*b* and 12*c* in FIG. 2B differs from that in FIG. 2A. In the example of FIG. 2B, the length of the slit SL formed in the feeding radiation electrodes 11*b* and 11*c* is increased to more than the length in the example of FIG. 2A, and the length of the slit SL formed in the parasitic radiation electrodes 12*b* and 12*c* is decreased to more than the length in the example of FIG. 2A. The length of the slit SL makes it possible to determine the inductance components of the feeding radiation electrodes 11*b* and 11*c* and the parasitic radiation electrode.

By mounting this antenna element 1 in the non-ground area UA of the substrate 2, power is supplied to the feeding radiation electrode 11*b* via the line 11*a* for the feeding radiation electrode, and the end portion of the line 12*a* for a parasitic radiation electrode is grounded to ground electrode 23.

Figure 3A:
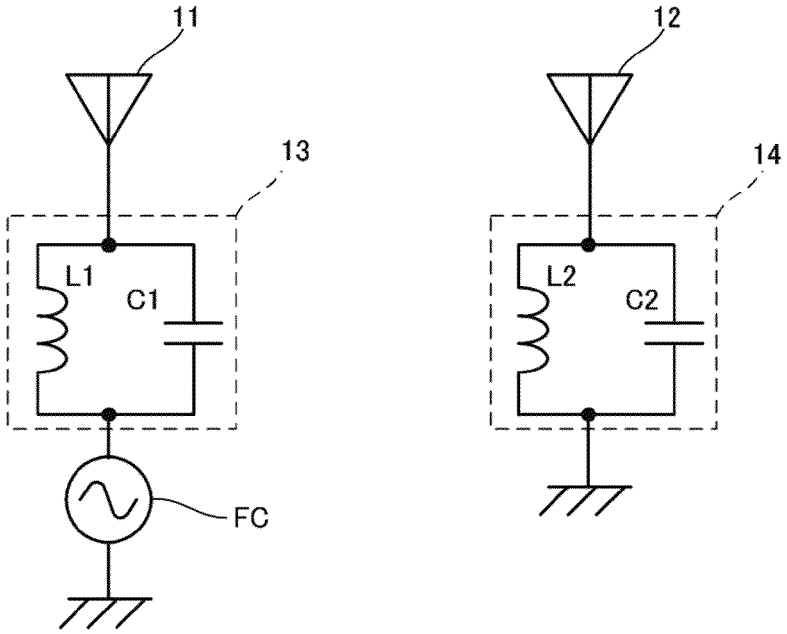
FIGS. 3A and 3B are two equivalent circuit diagrams of antennas according to the first exemplary embodiment.
Figure 3B:
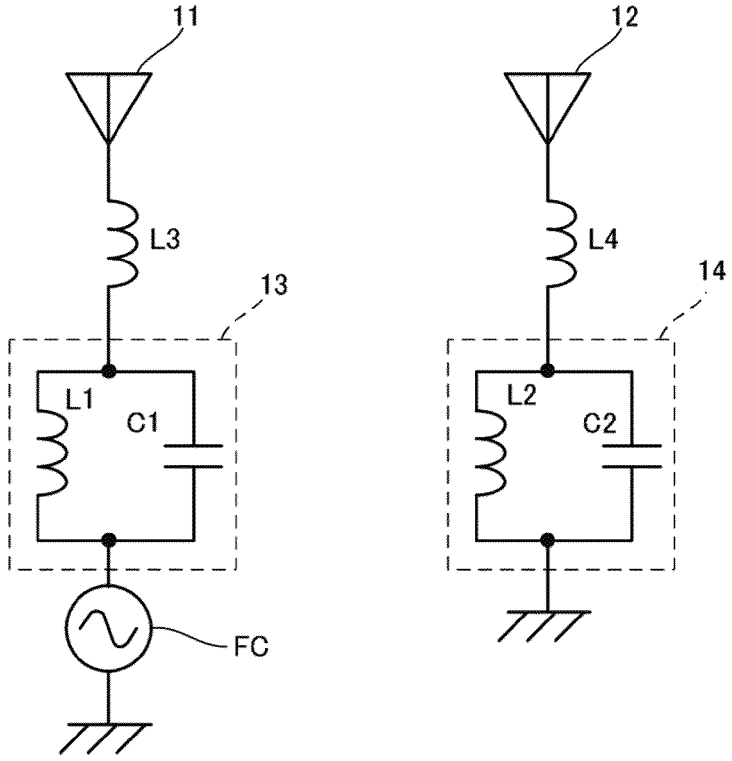

FIGS. 3A and 3B show two equivalent circuit diagrams of antennas according to the first exemplary embodiment. In the example of FIG. 3A, a first LC parallel circuit 13 is connected between a feeding circuit FC and the feeding element 11, and a second LC parallel circuit 14 is connected between the parasitic radiation electrode 12 and the ground.

In the example of FIG. 3B, a series circuit of a first LC parallel circuit 13 and an inductor L3 is connected between the feeding circuit FC and the feeding element 11, and a series circuit of a second LC parallel circuit 14 and an inductor L4 is connected between the parasitic radiation electrode 12 and the ground.

The first LC parallel circuit 13, the second LC parallel circuit 14, and the inductors L3 and L4 are provided in a feeding unit of a transmission and reception circuit mounted on the substrate 2 shown in FIGS. 2A and 2B.

In the example shown in FIGS. 2A and 2B, the line 11*a* for the feeding radiation electrode and the line 12*a* for the parasitic radiation electrode operate as impedance elements. FIG. 3B includes equivalent circuit diagrams in a case where, in addition to the lines 11*a* and 12*a*, an inductance element is further provided in series.

The connection order of the LC parallel circuits 13 and 14 and the inductors L3 and L4 is not limited to the example of FIG. 3B. Alternatively, the inductor L3 may be provided between the LC parallel circuit 13 and the feeding circuit FC. Furthermore, an inductor L4 may be provided between the LC parallel circuit 14 and the ground. In summary, the LC parallel circuits 13 and 14 and the inductors L3 and L4 should be in a series connected relation.

As shown in FIGS. 2A and 2B, if slits SL are formed in such a manner that the feeding radiation electrodes 11*b* and 11*c* and the parasitic radiation electrodes 12*b* and 12*c* each are formed in a spiral pattern, there is a case in which the inductors L3 and L4 shown in FIG. 3B are not necessary. However, if the feeding radiation electrode 11*b* and the parasitic radiation electrode 12*b* are made to be close to so-called solid electrodes, advantages can be obtained such that an electric field rises in a capacitance caused to occur in the spiral slit portion, the electric field does not become indistinct as a whole, and the electric field is distributed and becomes easy to jump, thereby obtaining wide band characteristics.

Figure 4A:
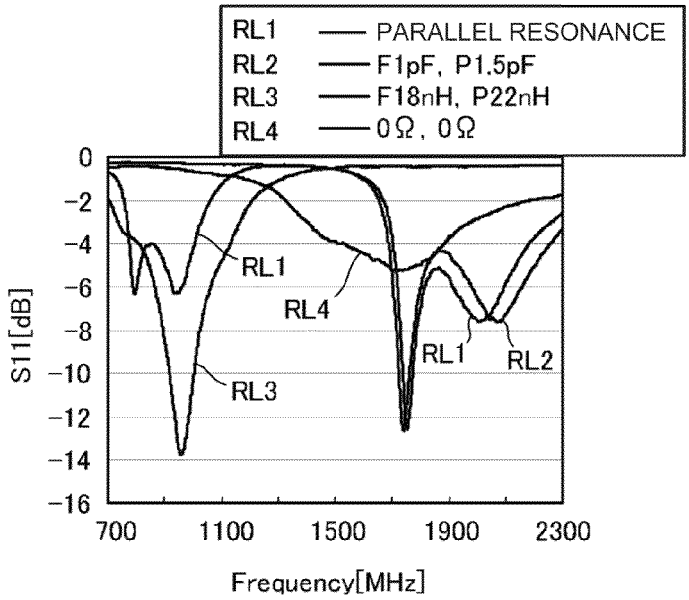
FIGS. 4A and 4B show the operational effects as a result of providing LC parallel circuits shown in FIG. 3, and providing inductors, and a design method thereof.
Figure 4B:
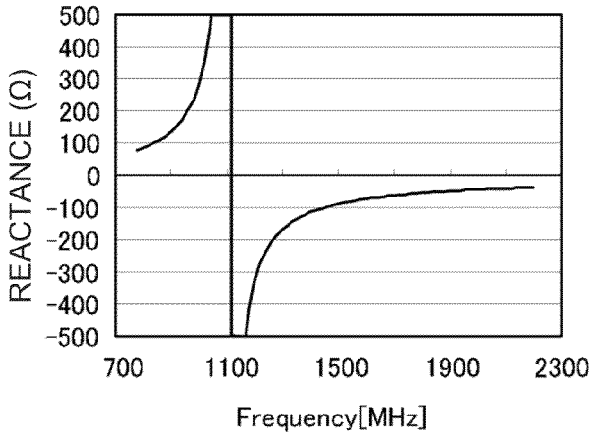

FIGS. 4A and 4B show operational effects obtained by providing the LC parallel circuits 13 and 14 shown in FIG. 3B and providing the inductors L3 and L4, and a design method thereof.

First, the antenna element 1 shown in FIGS. 2A and 2B uses resonance in the fundamental wave mode at both an operating frequency band (hereinafter referred to simply as a low operating frequency) on a low frequency side and an operating frequency band (hereinafter referred to simply as a high operating frequency) on a higher frequency side. Then, in a state in which the first and second LC parallel circuits 13 and 14 do not exist, the feeding element 11 and the parasitic element 12 produce a multiple resonance state at a frequency between a low operating frequency and a high operating frequency.

FIG. 4A shows a reflection loss (S11 characteristics) when viewed from the feeding circuit FC shown in FIG. 3. Here, a characteristic curve RL4 shows characteristics in a case where the LC parallel circuits 13 and 14 do not exist (in a case where the inductors L1 and L2 and the capacitors C1 and C2 have 0Ω). As described above, a multiple resonance state is produced at a frequency between a low operating frequency and a high operating frequency (approximately 1500 MHz and 1700 MHz).

In a state in which the LC parallel circuits 13 and 14 do not exist, the width of the frequency band in which the return loss of the characteristic curve RL4 becomes a predetermined amount or more is determined by the strength of the coupling between the radiation electrode 11*b* of the feeding element 11 and the radiation electrode 12*b* of the parasitic element 12.

Furthermore, the resonance frequency of multiple resonance is determined by the lengths of the feeding radiation electrode 11*b* and the parasitic radiation electrode 12*b*, and the like. Furthermore, as shown in FIG. 3B, in a case where the series inductors L3 and L4 are to be provided, the resonance frequency of multiple resonance is determined by determining the inductance values thereof. In a case where the series inductors L3 and L4 are not provided, slits may be formed in the feeding radiation electrode 11*b* and the parasitic radiation electrode 12*b*, so that the resonance frequency is determined by the slit length and the slit interval.

The LC parallel resonance frequency of each of the first LC parallel circuit 13 and the second LC parallel circuit 14 is determined so that the first LC parallel circuit 13 and the second LC parallel circuit 14 operate so as to be inductive at a low operating frequency (for example, 850 to 900 MHz of GSM or the like) and operate so as to be capacitive at a high operating frequency (for example, 1710 to 2170 MHz of DCS/PCS/UMTS or the like).

FIG. 4B shows frequency characteristics of reactance with respect to the frequency of each of the first LC parallel circuit 13 and the second LC parallel circuit 14. As described above, the LC parallel circuits constitute an LC parallel resonance circuit. Therefore, at a frequency lower than the resonance frequency (in this example, L=8 nH, C=2.6 pF, and the resonance frequency is approximately 1100 MHz), in the LC parallel circuits 13 and 14, the impedances of the inductors L1 and L2 become dominant; and at a high operating frequency, the capacitance components of the C1 and C2 become dominant.

More specifically, first, in a state in which the capacitor C1 is inserted between the feeding element 11 and the feeding circuit FC and the capacitor C2 is inserted between the parasitic element 12 and the ground, frequency adjustment is performed on a high operating frequency. In FIG. 4A, a characteristic curve RL2 represents characteristics in a case where C1=1 pF and C2=1.5 PF. By inserting the capacitors C1 and C2, the multiple resonance frequency is shifted from the state in which the antenna is multiply resonated at a frequency of approximately 1500 MHz and 1700 MHz in the manner described above to a higher operating frequency side (approximately 1750 MHz and 2100 MHz).

Next, an inductor L1 is inserted between the feeding element 11 and the feeding circuit FC, an inductor L2 is inserted between the parasitic element 12 and the ground, and frequency adjustment is performed on a low operating frequency. In FIG. 4A, a characteristic curve RL3 represents characteristics in a case where L1=18 nH and L2=22 nH. By inserting the inductors L1 and L2, the multiple resonance frequency is shifted from the state in which the antenna is multiply resonated at a frequency of approximately 1500 MHz and 1700 MHz in the manner described above to a lower operating frequency side (approximately 750 MHz and 940 MHz).

The approximate values of C1, C2, L1, and L2 of the LC parallel circuits 13 and 14 are determined in the manner described above. After that, the values of C1, C2, L1, and L2 of the LC parallel circuits 13 and 14 are finely adjusted so that the frequency of the multiple resonance at a low operating frequency and the frequency of the multiple resonance at a high operating frequency become predetermined frequencies.

In FIG. 4A, a characteristic curve RL1 represents characteristics in a case where C1=2 pF, L1=8.2 nH, C2=2.25 pF, and L2=8.2 nH.

In the manner described above, a multiple resonance state in the fundamental wave mode can be produced at both a low operating frequency and a high operating frequency.

Figure 5:
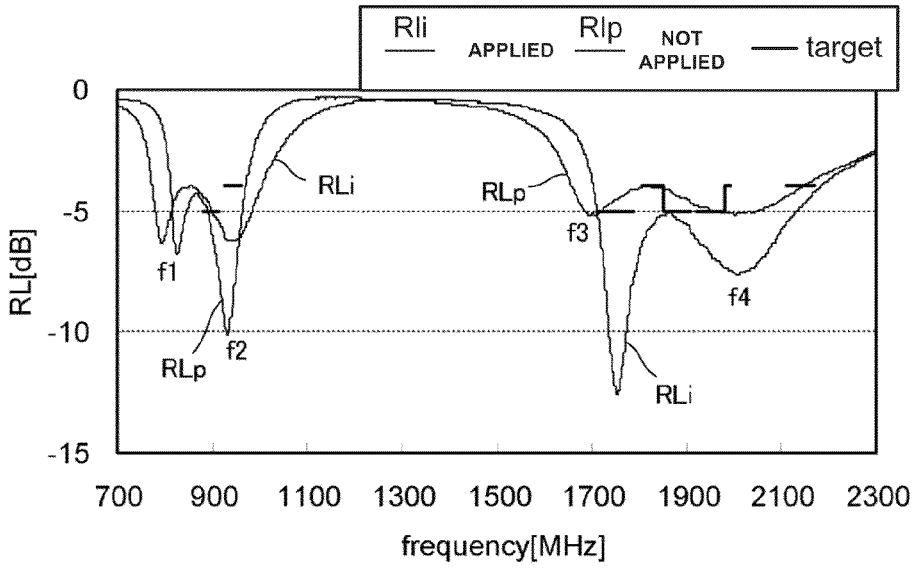
FIG. 5 shows characteristics of the return loss of the antenna according to the first exemplary embodiment and an antenna according to the related art.

FIG. 5 shows the characteristics of return loss of an antenna according to the first exemplary embodiment and an antenna of the related art. Here, the characteristic curve RLi represents the return loss characteristics of an antenna according to the first exemplary embodiment, and RLp represents the return loss characteristics of the antenna of the related art. f1 and f2 in the figure indicate the frequencies of the multiple resonance at a low operating frequency. f3 and f4 indicate the frequencies of multiple resonance at a high operating frequency.

The antenna of the related art resonates in the harmonic mode of a ¾ wavelength at a high operating frequency, and resonates in the fundamental wave mode of a ¼ wavelength at a low operating frequency. As a result of using the harmonic mode of a ¾ wavelength as described above, the return loss at a high operating frequency is not decreased sufficiently. In comparison, in the antenna according to the first exemplary embodiment, a sufficient return loss characteristic is obtained at both a low operating frequency and a high operating frequency, and highly efficient antenna characteristics are obtained over a wide band.

The antenna of the related art, in which a high operating frequency is made to resonate in a harmonic mode of a ¾ wavelength, is such that long slits are formed so that the radiation electrodes 11*b* and 12*b* of the feeding element 11 and the parasitic element 12 shown in FIGS. 2A and 2B each are formed in a long spiral pattern. In such an antenna of the related art, a capacitance occurs in a spiral slit portion, and an electric field rises therein. Consequently, the electric field easily stays there. In comparison, in the antennas 200 and 201 according to the first exemplary embodiment, by making the radiation electrodes 11*b* and 12*b* be close to so-called solid electrodes, and the electric field is distributed and becomes easy to jump to the outside, thereby obtaining wide band characteristics.

If the parasitic element 12 is eliminated and single resonance is performed, the resonance frequency is decreased to more than a desired frequency at only the space on the feeding element 11 side, and the space of the parasitic element 12 is wasted. Therefore, as a result of arranging the feeding element 11 and the parasitic element 12 as shown in FIGS. 2A and 2B, by fully utilizing the mounting permission space of the antenna element 1, it is always possible to radiate with the entire volume of the antenna.

Figure 6:
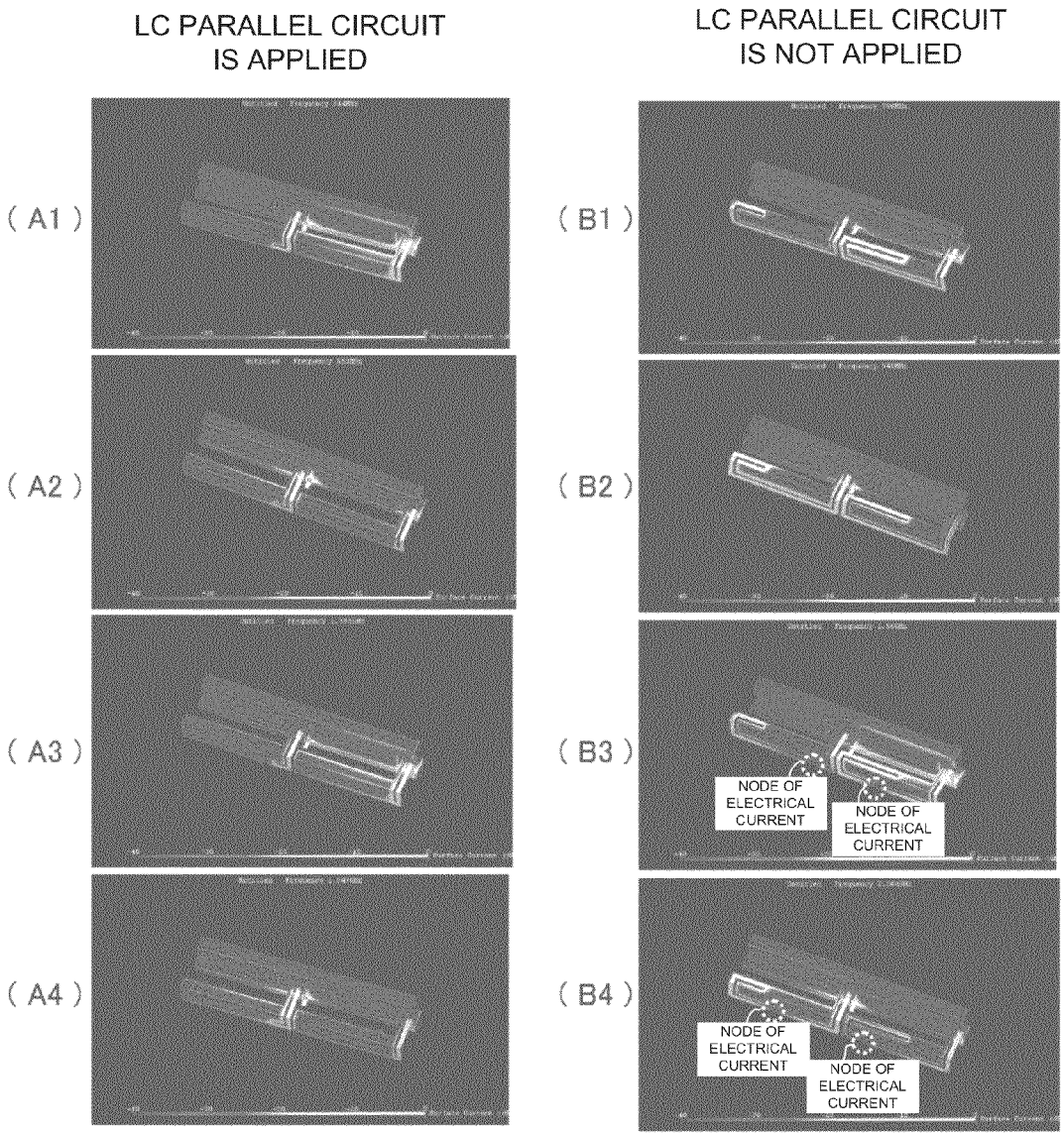
FIG. 6 shows that the electrical current distributions at each of frequencies f1, f2, f3, and f4 of the antenna of the related art and the antenna according to the first exemplary embodiment are determined by simulation.

FIG. 6 shows an electrical current distribution, which is determined by simulation, at each of frequencies f1, f2, f3, and f4 of the antenna of the related art and the antenna according to the first exemplary embodiment.

In FIG. 6, (A1) to (A4) show the case of the antenna (antenna shown in FIG. 2B) according to the first exemplary embodiment, and (B1) to (B4) show the case of the antenna of the related art. (A1) and (B1) show an electrical current distribution at the frequency f1 (see FIG. 5); (A2) and (B2) show an electrical current distribution at the frequency f2; (A3) and (B3) show an electrical current distribution at the frequency f3; and (A4) and (B4) show an electrical current distribution at the frequency f4.

As described above, at the frequencies f1 and f2 (low operating frequencies), a node of the electrical current does not occur in either of the antenna of the related art and the antenna according to the first exemplary embodiment. However, at high operating frequencies (f3, f4), in the antenna of the related art, which operates in harmonics of a ¾ wavelength, the node of the electrical current is seen, as shown in (B3) and (B4).

Since, in harmonics, two concentration points of the electric field exist, the Q value of resonance is high, and influence is easily received by the ground electrical potential and the proximity of a metal with respect to the fundamental wave. In contrast, in the antenna according to the first exemplary embodiment, since resonance is performed in the fundamental wave mode also at high operating frequencies (f3, f4), this problem does not arise.

As has been described in the foregoing, according to the present invention, since resonance of the fundamental wave mode can be used even at a high operating frequency, a wider band and a higher efficiency can be achieved, and influence is not easily received with respect to proximity of a conductor such as a metal or a human body. Furthermore, in a low frequency band, an inductor L is equivalently put in series, the length of a slit necessary for a radiation electrode is decreased, an electrode pattern is simplified, and the electric field in the antenna is easy to be distributed. In consequence, a high efficiency state can be realized in a wide band. In addition, radiation is always possible with the entire volume of the antenna, and thus, the antenna permission space can be fully utilized.

FIG. 7A is a plan view of an antenna 202 and 7B is a plan view of an antenna 203 according to a second exemplary embodiment, which are configured so as to multiply resonate by using two antenna elements.

In an antenna 202 shown in FIG. 7A, two antenna elements of the same type are used. One antenna element is mounted as a feeding-side antenna element 1F in a non-ground area UA and the other antenna element is mounted therein as a parasitic-side antenna element 1P. A first LC parallel circuit 13 is provided between a feeding circuit FC and the feeding end of the feeding-side antenna element 1F. Furthermore, a second LC parallel circuit 14 is provided between the grounding end of the parasitic-side antenna element 1P and the ground electrode 23.

In an antenna 203 shown in FIG. 7B, two types of antenna elements, which are symmetric with each other, are used. One antenna element is used as a feeding-side antenna element 1F and the other antenna element is used as a parasitic-side antenna element 1P. Similar to the case of FIG. 7A, the two antenna elements 1F and 1P are mounted in the non-ground area UA of the substrate and also, the first LC parallel circuit 13 and the second LC parallel circuit 14 are provided.

As described above, by using antenna elements on the feeding side and on the parasitic side independently from each other, it is possible to increase the degree of flatness of the mounting surface for the substrate. Thus, surface mounting can be facilitated and also, the reliability thereof can be increased. Furthermore, the optimum positions of the feeding end and the grounding end can be selected according to conditions, thereby achieving a wider band and a higher efficiency. Furthermore, since the number of types of parts is decreased, costs can be reduced correspondingly.

FIG. 8 is a plan view of an antenna 204 according to a third exemplary embodiment.

In this antenna 204, a feeding-side antenna element 1F and a parasitic-side antenna element 1P are mounted in a non-ground area UA of a substrate. Unlike the example of FIG. 7, the two antenna elements 1F and 1P are arranged so as to be inclined in such a manner as to match the shape of the end portion of the substrate 2. The two antenna elements 1F and 1P are the same as the antenna elements 1F and 1P shown in FIG. 7A or FIG. 7B. In FIG. 8, while illustration of the first and second LC parallel circuits and the feeding circuit is omitted, these circuits should be formed by the same method as that of the second exemplary embodiment. The LC parallel circuit is formed of a combination of an inductor and a capacitor, and the inductor can be formed of a detour circuit using an electrode pattern.

By appropriately selecting the spacing between the feeding-side antenna element 1F and the parasitic-side antenna element 1P and the angles thereof in the manner described above, the feeding-side antenna element 1F and the parasitic-side antenna element 1P can be incorporated in a limited space inside a housing, and antenna characteristics can be determined as appropriate.

FIG. 9 is a plan view of an antenna 205 according to a fourth exemplary embodiment.

In an antenna 205, an inductance element (circuit element having inductance components) 24 which is connected between the feeding point of a feeding-side antenna element 1F and a first LC parallel circuit 13, and an inductance element (circuit element having inductance components) 25 which is connected between the grounding end of a parasitic-side antenna element 1P and a second LC parallel circuit 14 are each formed by a pattern electrode in a non-ground area UA of the substrate 2. The inductance elements 24 and 25 correspond to the series connected inductors L3 and L4 shown in FIG. 3B. The remaining configuration can be the same as the case of FIG. 7A.

As has been described above, the non-ground area UA of the substrate 2 can be effectively used, and the number of parts to be mounted can be reduced.

Because embodiments consistent with the claimed invention can use resonance in a fundamental wave mode even at a high operating frequency, a wider band and a higher efficiency can be achieved, and influence is not easily received by proximity of a conductor, such as a metal or a human body.

Furthermore, in a low frequency band, an inductor L is equivalently put in series. A slit necessary for a radiation electrode can be shortened, an electrode pattern can be simplified, and the electric field on the antenna can be easily distributed. Therefore, a highly efficient state can be realized in a wide band.

Furthermore, since radiation is possible with the total volume of the antenna, the antenna permission space can be fully utilized.

While exemplary embodiments of the invention have been described above, it is to be understood that variations and modifications will be apparent to those skilled in the art without departing from the scope and spirit of the invention. The scope of the invention, therefore, is to be determined solely by the following claims and their equivalents.

What is claimed is:

1. A multiband antenna that resonates at each of at least two operating frequency bands on a lower frequency side and on a higher frequency side, the multiband antenna comprising:

a feeding element including a feeding radiation electrode and a parasitic element including a parasitic radiation electrode formed on a dielectric base;

a first LC parallel circuit having a first impedance between the feeding radiation electrode and a feeding circuit; and a second LC parallel circuit having a second impedance between the parasitic radiation electrode and a ground, wherein of the feeding element and the parasitic element are configured such that multiple resonance frequencies are positioned between the two operating frequency bands in a case where impedances of the first and second LC parallel circuits are set to 0, and inductors of the LC parallel circuits having said first and second impedances result in multiple resonance frequencies in an operating frequency band on the lower frequency side of the two operating frequency bands, and capacitors of the LC parallel circuits having said first and second impedances result in multiple resonance frequencies in an operating frequency band on the higher frequency side of the two operating frequency bands.

2. The multiband antenna according to claim 1, wherein a circuit element having inductance components is provided in series with the first LC parallel circuit and is provided in series with the second LC parallel circuit.

3. A mounting structure for a substrate of the multiband antenna according to claim 1, wherein the substrate includes a ground area in which a ground electrode is formed and a non-ground area in which a ground electrode is not formed in an end portion thereof, and wherein the multiband antenna is disposed in the non-ground area of the substrate.

4. A mounting structure for a substrate of the multiband antenna according to claim 2, wherein the substrate includes a ground area in which a ground electrode is formed and a non-ground area in which a ground electrode is not formed in an end portion thereof, and wherein the multiband antenna is disposed in the non-ground area of the substrate.

5. The mounting structure of claim 3, wherein the feeding radiation electrode and the parasitic radiation electrode are formed on a main surface farthest from the ground area of the substrate.

6. The mounting structure of claim 4, wherein the feeding radiation electrode and the parasitic radiation electrode are formed on a main surface farthest from the ground area of the substrate.

7. The mounting structure for the multiband antenna according to claim 3, wherein the dielectric base comprises individual dielectric bases and the feeding element and the parasitic element are formed on the individual dielectric bases, respectively, and the feeding element and the parasitic element are arranged adjacent to each other.

8. The mounting structure for the multiband antenna according to claim 4, wherein the dielectric base comprises individual dielectric bases and the feeding element and the parasitic element are formed on the individual dielectric bases, respectively, and the feeding element and the parasitic element are arranged adjacent to each other.

9. The mounting structure for the multiband antenna according to claim 5, wherein the feeding element and the parasitic element are formed in individual dielectric bases, and the feeding element and the parasitic element are arranged adjacent to each other.

10. The mounting structure for the multiband antenna according to claim 6, wherein the feeding element and the parasitic element are formed in individual dielectric bases, and the feeding element and the parasitic element are arranged adjacent to each other.

11. The multiband antenna according to claim 3, wherein the circuit element having inductance components is a pattern electrode formed on the substrate.

12. The multiband antenna according to claim 4, wherein the circuit element having inductance components is a pattern electrode formed on the substrate.

13. The multiband antenna according to claim 5, wherein the circuit element having inductance components is a pattern electrode formed on the substrate.

14. The multiband antenna according to claim 6, wherein the circuit element having inductance components is a pattern electrode formed on the substrate.

15. The multiband antenna according to claim 7, wherein the circuit element having inductance components is a pattern electrode formed on the substrate.

16. The multiband antenna according to claim 8, wherein the circuit element having inductance components is a pattern electrode formed on the substrate.

17. The multiband antenna according to claim 9, wherein the circuit element having inductance components is a pattern electrode formed on the substrate.

18. The multiband antenna according to claim 10, wherein the circuit element having inductance components is a pattern electrode formed on the substrate.

19. The multiband antenna according to claim 1, wherein the first LC parallel circuit is a parallel connection between a first capacitor and inductor pair, and the first capacitor and inductor pair of the first LC parallel circuit is connected in series between a feeding circuit and the feeding element, and wherein the second LC parallel circuit is a parallel connection between a second capacitor and inductor pair, and the second capacitor and inductor pair of the second LC parallel circuit is connected in series between the parasitic radiation electrode and the ground.

20. The mounting structure according to claim 3, wherein the first LC parallel circuit is a parallel connection between a first capacitor and inductor pair, and the first capacitor and inductor pair of the first LC parallel circuit is connected in series between a feeding circuit and the feeding element, and wherein the second LC parallel circuit is a parallel connection between a second capacitor and inductor pair, and the second capacitor and inductor pair of the second LC parallel circuit is connected in series between the parasitic radiation electrode and the ground.

* * * * *